United States Patent [19]

Jones

[11] Patent Number: 4,898,215

[45] Date of Patent: Feb. 6, 1990

[54] ELECTRICAL CONTACT BENDER

[75] Inventor: Gerald M. Jones, Titusville, Pa.

[73] Assignee: GTE Products Corporation, Stamford, Conn.

[21] Appl. No.: 308,073

[22] Filed: Feb. 9, 1989

[51] Int. Cl.[4] ..... B21F 1/00

[52] U.S. Cl. ..... 140/105; 29/239; 264/277

[58] Field of Search ..... 29/739, 872, 882; 264/277; 140/105

[56] References Cited

U.S. PATENT DOCUMENTS

| | | | |
|---|---|---|---|
| 3,524,240 | 8/1970 | Walker et al. | 29/739 X |
| 3,916,513 | 11/1975 | Ballard | 264/277 X |
| 4,292,736 | 10/1981 | Hughes et al. | 29/876 X |
| 4,337,574 | 7/1982 | Hughes et al. | 264/277 X |
| 4,488,355 | 12/1984 | Hutchins et al. | 29/882 |

OTHER PUBLICATIONS

IBM Tech. Discl. Bull., vol. 8, No. 9, Feb. 1966, pp. 1208–1209, by R. G. Hastede et al.

*Primary Examiner*—Carl J. Arbes

*Attorney, Agent, or Firm*—William H. McNeill

[57] ABSTRACT

An apparatus for forming the contact leads of a connector block, said connector block comprising an electrically insulating body having a plurality of in-line aperture therein arrayed along an axis of said body and an electrical contact in each of said apertures, each of said contacts having a shoulder resting on a flow of said block and having a tail protruding therefrom, said apparatus comprising: means for engaging said block to hold said block firmly in a given position; means for engaging an upper portion of said contacts to apply pressure against said shoulder; tail engaging means for engaging said protruding tails of said contact; and means connected to said tail engaging means for causing said tail engaging means to pivot substantially away from the vertical a given amount and bend said tails substantially the same amount.

5 Claims, 2 Drawing Sheets

ELECTRICAL CONTACT BENDER

TECHNICAL FIELD

This invention relates to electrical connector making apparatus and more Particularly to apparatus for making electrical connectors whose contacts include right angled portions.

BACKGROUND ART

Many forms of electrical connectors require their contacts to be bent to include a substantial angle; usually 90°. The conventional method of bending contacts is to place the contacts over a steel mandrel and push the mandrel forward to "plow" the contacts 90°. If the contacts are solder plated, this often results in skived solder, slivers, or occasional bare material. Additionally, solder can build up on the steel mandrels. Also, there can be present inconsistent spring back of the contact. Together, these conditions result in excessive quality inspection, reworking, rejections and maintenance.

DISCLOSURE OF THE INVENTION

It is, therefore, an object of this invention to obviate the disadvantages of the prior art.

It is another object of the invention to enhance connector fabrication.

Yet another object of the invention is the provision of apparatus to solve the problems of the prior art.

These objects are accomplished, in one aspect of the invention, by the provision of an apparatus for forming the contact leads of a connector block, said connector block comprising an electrically insulating body having a plurality of in-line apertures therein arrayed along an axis of said body and an electrical contact in each of said apertures, each of said contacts having a shoulder resting on a floor of said block and having a tail protruding therefrom, said apparatus comprising means for engaging said block to hold said block firmly in a given position; means for engaging an upper portion of said contacts to apply pressure against said shoulder; tail engaging means for engaging said protruding tails of said contact; and means connected to said tail engaging means for causing said tail engaging means to pivot substantially away from the vertical a given amount and bend said tails substantially the same amount.

This concept obviates the disadvantages of the prior art. The tail engaging means are mounted on a pivot. When a connector is in position, the apex of the bend to be is aligned with the pivot. The tail engaging means are behind the contacts. As the means are pivoted, they pick up the contacts and swing them 90°. The contacts can easily be overbent to compensate for spring back by increasing the pivot motion. The previously employed sliding action between the contacts and the mandrel has been eliminated, thereby eliminating the plowing and skiving of the solder plating. Maintenance is reduced and quality and productivity are increased.

BEST MODE FOR CARRYING OUT THE INVENTION

Figure 1:
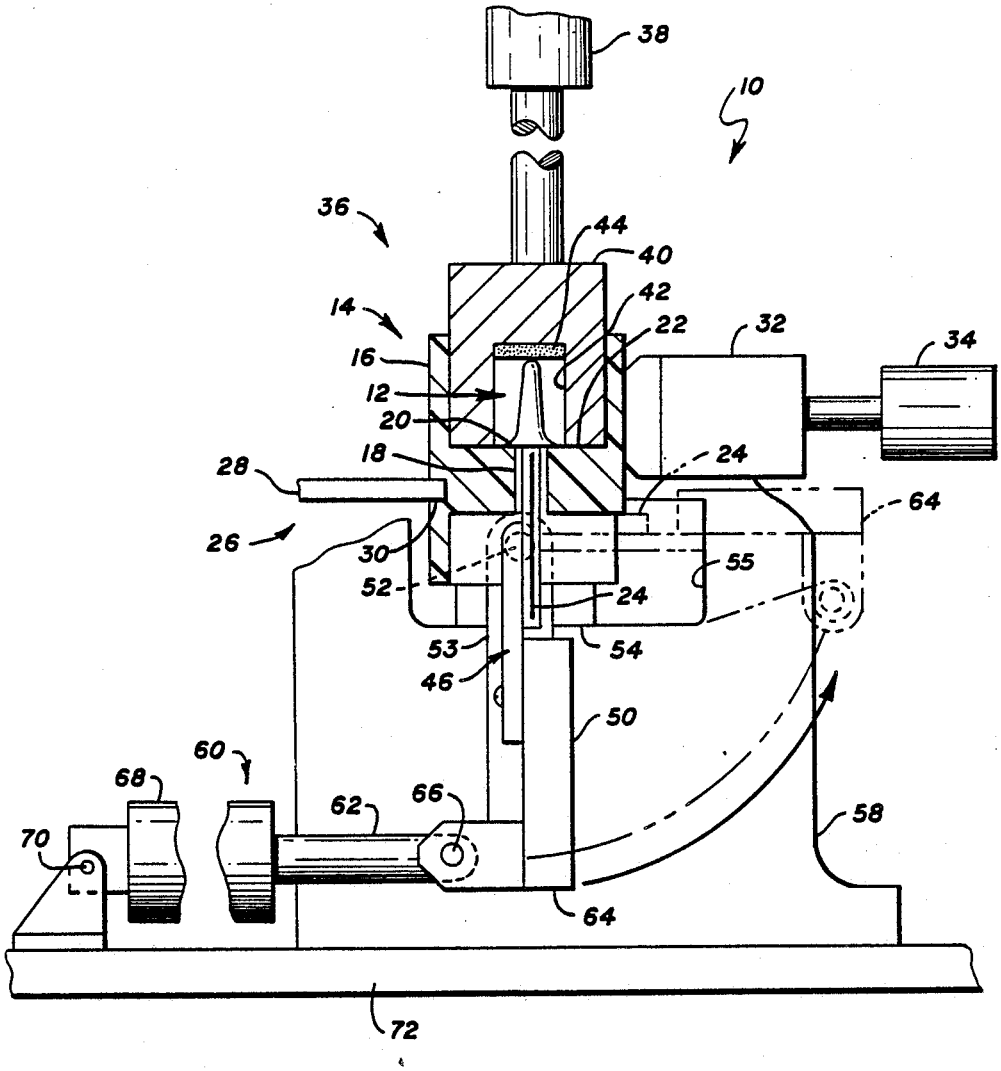
FIG. 1 is a side elevational view of the apparatus with a connector block in position.
Figure 2:
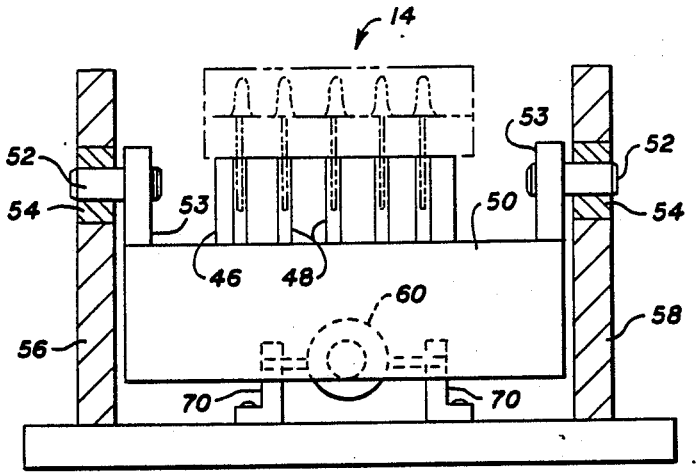
FIG. 2 is an end elevational view of the apparatus with a connector block shown in phanton.

For a better understanding of the present invention, together with other and further objects, advantages, and capabilities thereof, reference is made to the following disclosure and appended claims taken in conjunction with the above-described drawings.

Referring now to the drawings with greater particularity, there is shown an apparatus 10 for forming the contact leads 12 of a connector 14. The connector comprises an electrically insulating body 16 having a plurality of in-line apertures 18 therein. The apertures 18 are arrayed along an axis of body 16, e.g., a longitudinal axis.

An electrical contact lead 12 is positioned within each of the apertures 18 and each contact 12 has a shoulder 20 resting on a floor 22 of body 16 and a tail 24 protruding from the body.

The apparatus 10 comprises body engaging means 26 which holds the body firmly in position and can comprise a first plate 28 which fits into a slot 30 in body 16 and a second plate 32 which engages a side of body 16 opposite the first plate and which can be actuated by a fluid motor 34.

Additionally, engaging means 36, which can be driven by a fluid motor 38, is provided to engage the upper portion of the contacts 12 to apply pressure thereto to ensure that the shoulders 20 remain in contact with the floor 22 during the bending operation. This is a necessary feature when the contacts 12 are fitted loosely within apertures 18, but may be omitted if the contacts 12 are tightly held within the apertures 18.

Means 36 can comprise a fitted block 40 containing a plurality of contact receiving apertures 42, suitably cushioned as at 44 to prevent damage to the contacts.

Apparatus 10 further includes tail engaging means 46 for engaging the protruding tails 24 of the contacts 12. To ensure the proper location of the tails, grooves 48 are provided in the contacting surface of tail engaging means 46.

Figure 3:
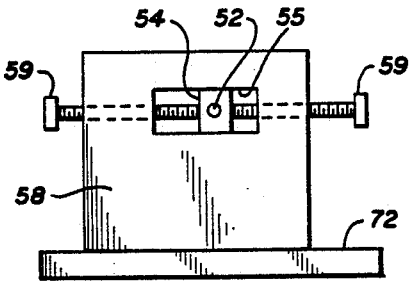
FIG. 3 is a side elevational view of the adjustable member.

The tail engaging means 46 is mounted upon a block 50 which is pivotally mounted by studs 52 (in extended arms 53) positioned in adjustable members 54 which are in turn carried in slots 55 in supporting walls 56 and 58. Adjustable members 54 are positioned by adjusting screws 59. (See FIG. 3)

Fluid motor means 60 is connected, via shaft 62, to the lower edge 64 of block 50 and is suitably pivotally journeled therein, as at 66. The base 68 of motor 60 is pivotably journeled as at 70, the journel mounting being affixed to the apparatus base 72.

In operation, a connector 14 with contacts 12 therein, is positioned with the body holding means 26 engaged. Fluid motor 38 is actuated to apply pressure to the tops of contacts 12 and hold them in position. Tails 24 are in position in grooves 48 of tail engaging means 46 and fluid motor 60 is actuated, pivoting block 50 and the attached tail engaging means 46 to the position shown in phanton in FIG. 1; i.e., approximately 90° from the vertical starting position. The contact tails 24 are, of course, bent to the same angle; however, without any of the previously applied sliding, or plowing action which detrimentally effected the contacts.

While the above illustrative example depicts a 90° bend, other angles, greater than or less than 90°, are of course, possible with utilization of this invention.

While there have been shown what are at present considered to be the preferred embodiments of the invention, it will be apparent to those skilled in the art that various changes and modifications can be made herein without departing from the scope of the invention as defined by the appended claims.

I claim:

1. An apparatus for forming the contact leads of a connector block, said connector block comprising an electrically insulating body having a plurality of in-line apertures therein arrayed along an axis of said body and an electrical contact in each of said apertures, each of said contacts having a shoulder resting on a floor of said block and having a tail protruding therefrom, said apparatus comprising: means for engaging said block to hold said block firmly in a given position; means for engaging an upper portion of said contacts to apply pressure against said shoulder; tail engaging means for engaging said protruding tails of said contact; and means connected to said tail engaging means for causing said tail engaging means to pivot substantially away from the vertical a given amount and bend said tails substantially the same amount.

2. The apparatus of claim 1 wherein said means connected to said tail engaging means is a fluid motor.

3. The apparatus of claim 2 wherein said fluid motor has a shaft which is pivotably connected to a projection on said tail engaging means and a base which is pivotably mounted.

4. The apparatus of claim 1 wherein said tail engaging means is provided with tail receiving grooves.

5. The apparatus of claim 1 wherein said contact is bent substantially 90°.

* * * * *